US011085257B2

(12) United States Patent
Henry et al.

(10) Patent No.: US 11,085,257 B2
(45) Date of Patent: Aug. 10, 2021

(54) PARTICULATE DISPENSER

(71) Applicant: HALLIBURTON ENERGY SERVICES INC., Houston, TX (US)

(72) Inventors: Kevin Wayne Henry, Houston, TX (US); Courtney Pierre Robinson, Spring, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 16/877,052

(22) Filed: May 18, 2020

(65) Prior Publication Data

US 2020/0277829 A1 Sep. 3, 2020

Related U.S. Application Data

(62) Division of application No. 15/575,065, filed as application No. PCT/US2015/039402 on Jul. 7, 2015, now Pat. No. 10,697,261.

(51) Int. Cl.
*E21B 21/06* (2006.01)
*E21B 33/14* (2006.01)
(Continued)

(52) U.S. Cl.
CPC ..... *E21B 21/062* (2013.01); *E21B 33/14* (2013.01); *E21B 33/143* (2013.01); *E21B 33/16* (2013.01); *E21B 47/13* (2020.05)

(58) Field of Classification Search
CPC ..... E21B 21/062; E21B 47/13; E21B 33/14; E21B 33/143; E21B 33/16
See application file for complete search history.

(56) References Cited

U.S. PATENT DOCUMENTS 2,776,568 A * 1/1957 Ward ..... G01F 1/056 73/255
4,380,417 A 4/1983 Werner
(Continued)

FOREIGN PATENT DOCUMENTS

EP 0638402 A1 6/1994
EP 2543430 B1 1/2013
WO WO-9005019 A1 * 5/1990 ..... B03B 11/00

OTHER PUBLICATIONS

Examination Report, Australian Application No. 2015401565, dated Sep. 14, 2020.
(Continued)

*Primary Examiner* — Crystal J Miller
(74) *Attorney, Agent, or Firm* — Polsinelli PC

(57) ABSTRACT

Particulate dispenser can include a housing enclosing a receiving space. The housing having a fluid inlet aperture and a particulate input aperture, and a fluid outlet aperture. A hopper can be disposed above the housing and coupled to feed particulate from the hopper to the particulate input aperture. A wheel disposed within in the receiving space having at least one distribution aperture extending from the top surface to the bottom surface. The apertures being disposed at respective positions so that rotation of the wheel alternately aligns the distribution aperture with the particulate input aperture to feed particulate from the particulate input aperture into the distribution aperture and then aligns the distribution aperture with the fluid input aperture and the fluid output aperture to feed the particulate from the distribution aperture into the fluid flowing through the distribution aperture as the wheel rotates.

16 Claims, 14 Drawing Sheets

(51) Int. Cl.
*E21B 47/13* (2012.01)
*E21B 33/16* (2006.01)

(56) References Cited

U.S. PATENT DOCUMENTS

| | | | | |
|---|---|---|---|---|
| 4,840,292 | A * | 6/1989 | Harvey | E21B 43/267 222/1 |
| 8,640,915 | B2 | 2/2014 | Arcega | |
| 8,869,883 | B2 | 10/2014 | McGuire et al. | |
| 2007/0062700 | A1 | 3/2007 | Webb et al. | |
| 2008/0066911 | A1 * | 3/2008 | Luharuka | E21B 43/267 166/283 |
| 2011/0191028 | A1 | 8/2011 | Ross et al. | |
| 2014/0299320 | A1 | 10/2014 | Kleppa et al. | |
| 2015/0151899 | A1 * | 6/2015 | Reinhold | B65D 83/0409 221/1 |

OTHER PUBLICATIONS

Examination Report, Great Britain Application No. GB1719631.2, dated Sep. 30, 2020.
English abstract of EP0638402; retrieved from www.espacenet.com on Nov. 7, 2020.
International Search Report and Written Opinion; PCT Application No. PCT/US2015/039402; dated Mar. 10, 2016.
Search Report and Written Opinion; Singapore Application No. 11201709576P; dated Mar. 18, 2019.

* cited by examiner

PARTICULATE DISPENSER

CROSS-REFERENCE TO RELATED APPLICATIONS

This application is a divisional of U.S. application Ser. No. 15/575,065 filed Nov. 11, 2017, which claims benefit to national stage entry of PCT/US2015/039402 filed Jul. 7, 2015, said applications are expressly incorporated herein in their entirety.

FIELD

The subject matter herein generally relates to a particulate dispenser, and in particular, a particulate dispenser for use in wellbore cementing operations.

BACKGROUND

A wellbore is often drilled into a subterranean formation for recovering hydrocarbons, storing hydrocarbons, or injecting other fluids, such as carbon dioxide or aqueous fluids, for storage or disposal, or for recovery of deposited minerals or geothermal energy.

Typically the wellbore is lined with a steel casing through which fluid is conveyed under pressure. The steel casing is cemented in the wellbore in order to provide zonal isolation so that the fluid is extracted from or delivered to selected zones or layers of the formation and prevented from leaking into other zones or layers of the formation and leaking into the surface environment. The cement also bonds to and supports the casing.

For a well drilled into a rock formation, the wellbore is typically drilled into the rock, and then the casing is placed into the wellbore in the rock. A cement slurry is then pumped down through the casing, and the cement slurry flows out the bottom of the casing and rises up into the annulus around the casing in the wellbore. As the cement slurry is pumped, the pressure and flow rate are recorded in order to detect abnormalities. Tags, such as sensors, can be placed in the cement within the wellbore, to assist in obtaining or generating information about components within the wellbore.

DETAILED DESCRIPTION

Figure 1:
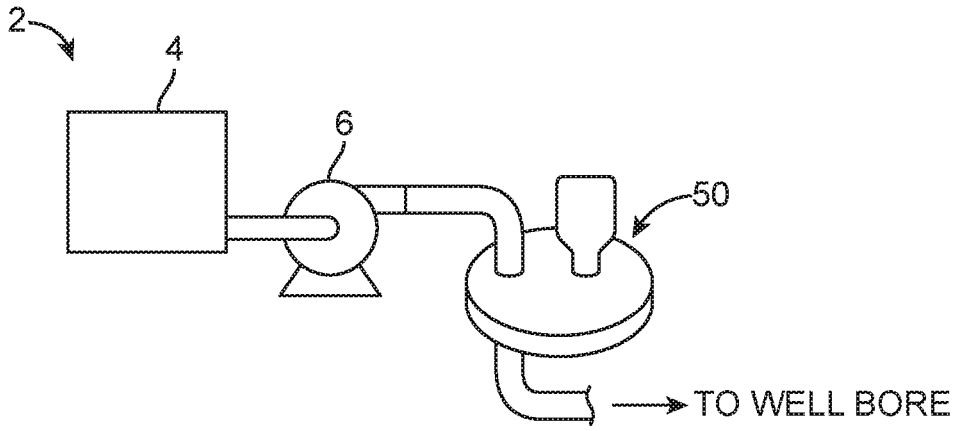
FIG. 1 illustrates a system for preparation and delivery of a cement composition to a wellbore in accordance with aspects of the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

In the following description, terms such as "upper," "upward," "lower," "downward," "above," "below," "downhole," "uphole," "longitudinal," "lateral," and the like, as used herein, shall mean in relation to the bottom or furthest extent of the surrounding wellbore even though the wellbore or portions of it may be deviated or horizontal. Correspondingly, the transverse, axial, lateral, longitudinal, radial, etc., orientations shall mean orientations relative to the orientation of the wellbore or tool.

The term "inside" indicate that at least a portion of a region is partially contained within a boundary formed by the object. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder.

The term "radially" means substantially in a direction along a radius of the object, or having a directional component in a direction along a radius of the object, even if the object is not exactly circular or cylindrical. The term "axially" means substantially along a direction of the axis of the object.

As used herein, "cement" is any kind of material capable of being pumped to flow to a desired location, and capable of setting into a solid mass at the desired location. "Cement slurry" designates the cement in its flowable state. In many cases, common calcium-silicate hydraulic cement is suitable, such as Portland cement. Calcium-silicate hydraulic cement includes a source of calcium oxide such as burnt limestone, a source of silicon dioxide such as burnt clay, and various amounts of additives such as sand, pozzolan, diatomaceous earth, iron pyrite, alumina, and calcium sulfate. In some cases, the cement may include polymer, resin, or latex, either as an additive or as the major constituent of the cement. The polymer may include polystyrene, ethylene/vinyl acetate copolymer, polymethylmethacrylate polyurethanes, polylactic acid, polyglycolic acid, polyvinylalcohol, polyvinylacetate, hydrolyzed ethylene/vinyl acetate, silicones, and combinations thereof. The cement may also include reinforcing fillers such as fiberglass, ceramic fiber, or polymer fiber. The cement may also include additives for improving or changing the properties of the cement, such as set accelerators, set retarders, defoamers, fluid loss agents, weighting materials, dispersants, density-reducing agents, formation conditioning agents, lost circulation materials, thixotropic agents, suspension aids, or combinations thereof.

The cement compositions disclosed herein may directly or indirectly affect one or more components or pieces of equipment associated with the preparation, delivery, recapture, recycling, reuse, and/or disposal of the disclosed cement compositions. For example, the disclosed cement compositions may directly or indirectly affect one or more mixers, related mixing equipment, mud pits, storage facilities or units, composition separators, heat exchangers, sensors, gauges, pumps, compressors, and the like used to generate, store, monitor, regulate, and/or recondition the exemplary cement compositions. The disclosed cement compositions may also directly or indirectly affect any transport or delivery equipment used to convey the cement compositions to a well site or downhole such as, for example, any transport vessels, conduits, pipelines, trucks, tubulars, and/or pipes used to compositionally move the cement compositions from one location to another, any pumps, compressors, or motors (e.g., topside or downhole) used to drive the binder compositions into motion, any valves or related joints used to regulate the pressure or flow rate of the binder compositions, and any sensors (i.e., pressure and temperature), gauges, and/or combinations thereof, and the like. The disclosed cement compositions may also directly or indirectly affect the various downhole equipment and tools that may come into contact with the cement compositions/additives such as, but not limited to, wellbore casing, wellbore liner, completion string, insert strings, drill string, coiled tubing, slickline, wireline, drill pipe, drill collars, mud motors, downhole motors and/or pumps, cement pumps, surface-mounted motors and/or pumps, centralizers, turbolizers, scratchers, floats (e.g., shoes, collars, valves, etc.), logging tools and related telemetry equipment, actuators (e.g., electromechanical devices, hydromechanical devices, etc.), sliding sleeves, production sleeves, plugs, screens, filters, flow control devices (e.g., inflow control devices, autonomous inflow control devices, outflow control devices, etc.), couplings (e.g., electro-hydraulic wet connect, dry connect, inductive coupler, etc.), control lines (e.g., electrical, fiber optic, hydraulic, etc.), surveillance lines, drill bits and reamers, sensors or distributed sensors, downhole heat exchangers, valves and corresponding actuation devices, tool seals, packers, cement plugs, bridge plugs, and other wellbore isolation devices, or components, and the like.

Disclosed herein is a particulate dispenser which facilitates the introduction of particulates into a fluid stream. During preparation or use of a well, fluid is provided downhole. The fluid or a portion thereof can be provided through the particulate dispenser to introduce particulate into the fluid stream. As disclosed herein, the fluid stream can include a cement composition which is pumped downhole to cement a casing in place within the wellbore. The particulate introduced into the cement, or other fluid, can include tags such as radio frequency identification (RFID) tags or Micro-Electro-Mechanical System (MEMS) data sensors tags for introduction into the cement fluid. The tags can assist in generating a variety of information about the composition and flow of the fluid, as well as information regarding the formation.

Referring now to FIG. 1, a system that may be used in the preparation of a cement composition in accordance with example embodiments will now be described. FIG. 1 illustrates a system 2 for preparation of a cement composition and delivery to a wellbore. While the exemplary embodiment discussed herein is a cement composition, the present disclosure relates to any fluid, such as a cement composition, wellbore fluid, brine, water, saltwater, production fluid, or other fluid. As shown, the cement composition may be mixed in mixing equipment 4, such as a jet mixer, recirculating mixer, or a batch mixer, for example, and then pumped via pumping equipment 6 to the wellbore. In some embodiments, the mixing equipment 4 and the pumping equipment 6 may be disposed on one or more cement trucks as will be apparent to those of ordinary skill in the art. In some embodiments, a jet mixer may be used, for example, to continuously mix the composition, including water, as it is being pumped to the wellbore.

Figure 2:
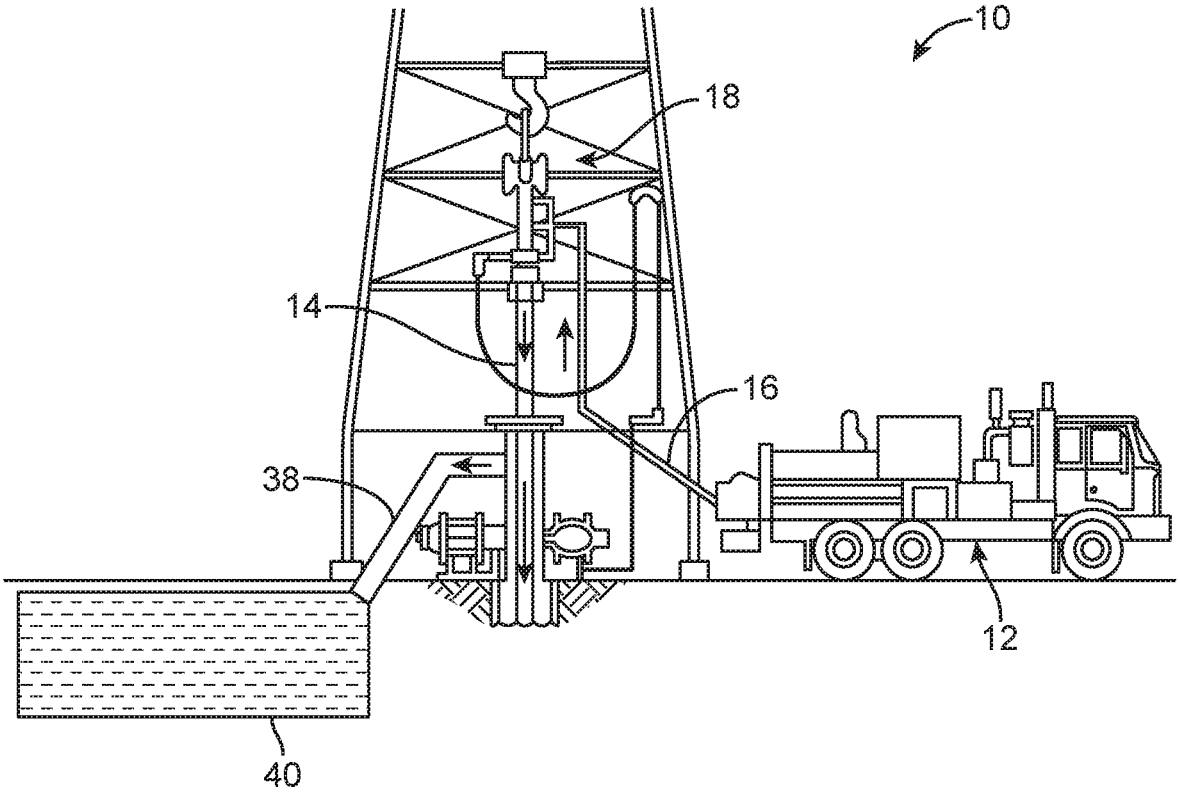
FIG. 2 is a diagram illustrating surface equipment that may be used in placement of a cement composition in a wellbore in accordance with aspects of the present disclosure.

An example technique and system for placing a cement composition into a subterranean formation will now be described with reference to FIGS. 2 and 3. FIG. 2 illustrates surface equipment 10 that may be used in placement of a cement composition in accordance with certain embodiments. It should be noted that while FIG. 2 generally depicts a land-based operation, those skilled in the art will readily recognize that the principles described herein are equally applicable to subsea operations that employ floating or sea-based platforms and rigs, without departing from the scope of the disclosure. As illustrated by FIG. 2, the surface equipment 10 may include a cementing unit 12, which may include one or more cement trucks. The cementing unit 12 may include mixing equipment 4 and pumping equipment 6 (e.g., FIG. 1) as will be apparent to those of ordinary skill in the art. The cementing unit 12 may pump a cement composition 14 through a feed pipe 16 and to a cementing head 18 which conveys the cement composition 14 downhole.

Figure 3:
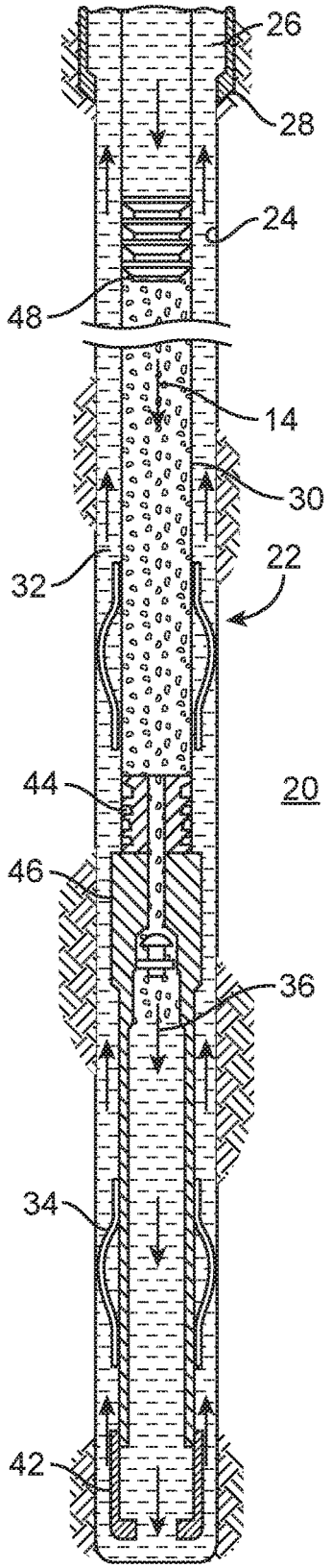
FIG. 3 is a diagram illustrating placement of a cement composition into a wellbore annulus in accordance with aspects of the present disclosure.

Turning now to FIG. 3, the cement composition 14 may be placed into a subterranean formation 20 in accordance with example embodiments. As illustrated, a wellbore 22 may be drilled into the subterranean formation 20. While wellbore 22 is shown extending generally vertically into the subterranean formation 20, the principles described herein are also applicable to wellbores that extend at an angle through the subterranean formation 20, such as horizontal and slanted wellbores. As illustrated, the wellbore 22 comprises walls 24. In the illustrated embodiments, a surface casing 26 has been inserted into the wellbore 22. The surface casing 26 may be cemented to the walls 24 of the wellbore 22 by cement sheath 28. In the illustrated embodiment, one or more additional conduits (e.g., intermediate casing, production casing, liners, etc.) shown here as casing 30 may also be disposed in the wellbore 22. As illustrated, there is a wellbore annulus 32 formed between the casing 30 and the walls 24 of the wellbore 22 and/or the surface casing 26. One or more centralizers 34 may be attached to the casing 30, for example, to centralize the casing 30 in the wellbore 22 prior to and during the cementing operation.

With continued reference to FIG. 3, the cement composition 14 may be pumped down the interior of the casing 30. The cement composition 14 may be allowed to flow down the interior of the casing 30 through the casing shoe 42 at the bottom of the casing 30 and up around the casing 30 into the wellbore annulus 32. The cement composition 14 may be allowed to set in the wellbore annulus 32, for example, to form a cement sheath that supports and positions the casing 30 in the wellbore 22. While not illustrated, other techniques may also be utilized for introduction of the cement composition 14. By way of example, reverse circulation techniques may be used that include introducing the cement composition 14 into the subterranean formation 20 by way of the wellbore annulus 32 instead of through the casing 30.

As it is introduced, the cement composition 14 may displace other fluids 36, such as drilling fluids and/or spacer fluids, that may be present in the interior of the casing 30 and/or the wellbore annulus 32. At least a portion of the displaced fluids 36 may exit the wellbore annulus 32 via a flow line 38 and be deposited, for example, in one or more retention pits 40 (e.g., a mud pit), as shown on FIG. 2. Referring again to FIG. 3, a bottom plug 44 may be introduced into the wellbore 22 ahead of the cement composition 14, for example, to separate the cement composition 14 from the fluids 36 that may be inside the casing 30 prior to cementing. After the bottom plug 44 reaches the landing collar 46, a diaphragm or other suitable device ruptures to allow the cement composition 14 through the bottom plug 44. In FIG. 3, the bottom plug 44 is shown on the landing collar 46. In the illustrated embodiment, a top plug 48 may be introduced into the wellbore 22 behind the binder composition 14. The top plug 48 may separate the cement composition 14 from a displacement fluid and also push the cement composition 14 through the bottom plug 44.

Figure 4:
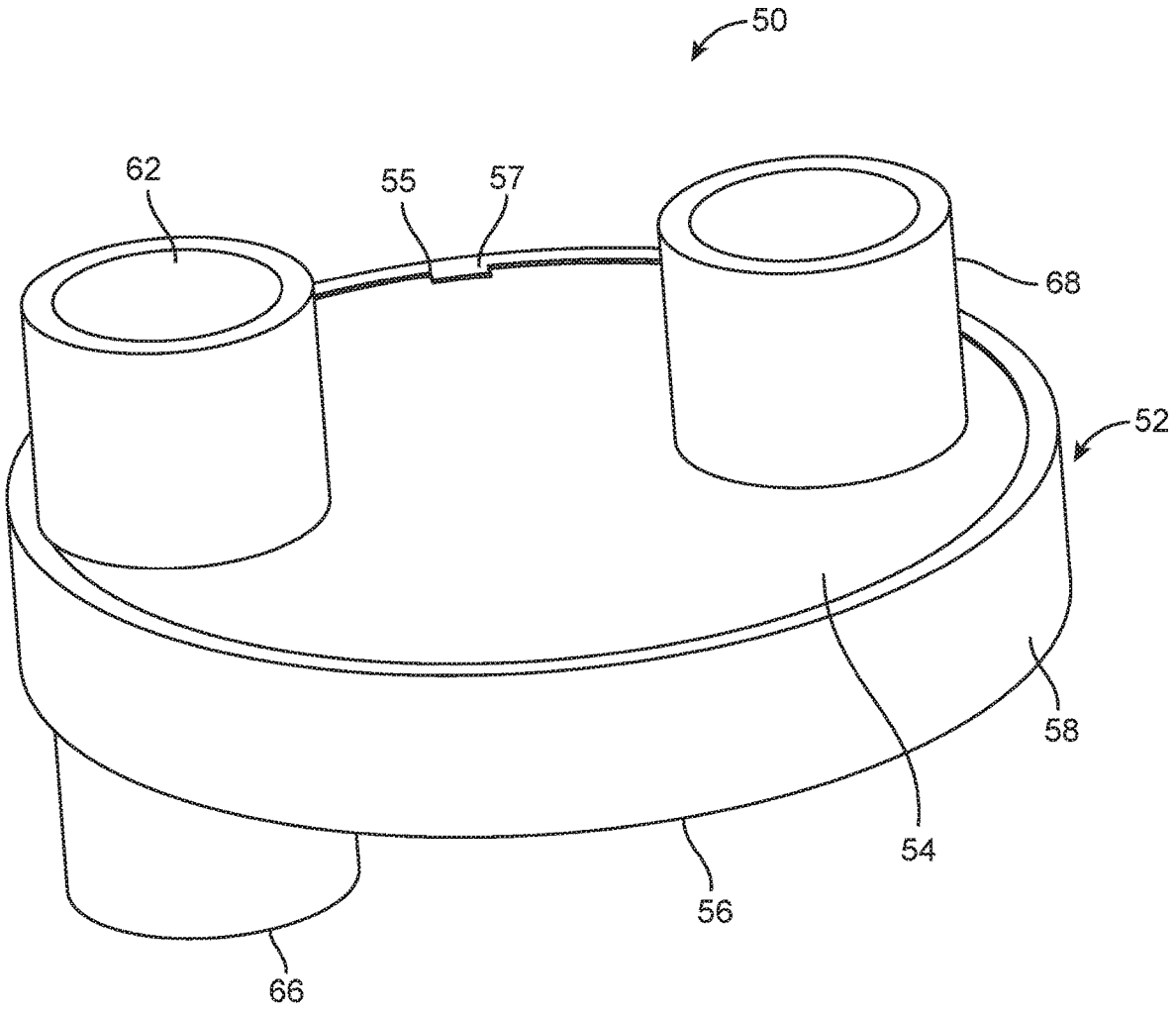
FIG. 4 is an isometric view of an exemplary embodiment of a particulate dispenser in accordance with aspects of the present disclosure.

Illustrated in FIG. 4 is a particulate dispenser 50 that can be used in the preparation of a fluid composition. While in the exemplary embodiments the fluid is a cement composition, the fluid can be any fluid, wellbore fluid, brine, water, saltwater, production fluid, or other fluid. The particulate dispenser 50 can have housing 52. The housing 52 can have an upper plate 54, a lower plate 56, and at least one side wall 58 enclosing a receiving space 60 (shown in FIG. 5). An edge of the upper plate 54 can have a groove 55 formed therein to receive a corresponding protrusion 57 on the sidewall 58 of the lower plate 56. The groove 55 and protrusion 57 can be matingly engaged to properly align the upper plate 54 and the lower plate 56.

The upper plate 54 can have a fluid inlet aperture 62 and the lower plate 56 can have a fluid outlet aperture 66. The fluid inlet aperture 62 can couple the particulate dispenser 50 with the pumping equipment 4 or other pressurized fluid source. (Shown in FIG. 1). The fluid outlet aperture 66 can couple the particulate dispenser with the wellbore 22 or related element of the system 2. The upper plate 54 can further include a hopper 68 coupled to the upper plate 54. The particulate dispenser 50 may receive only a portion of the fluid 67 flowing from the pumping equipment 4 or other pressurized fluid source, with the remaining flow bypassing the particulate dispenser 50 and merging with the flow at the fluid outlet aperture 66. Alternatively, the particulate dispenser 50 may receive the entire flow from the pumping equipment 4 or other pressurized fluid source.

Figure 5:
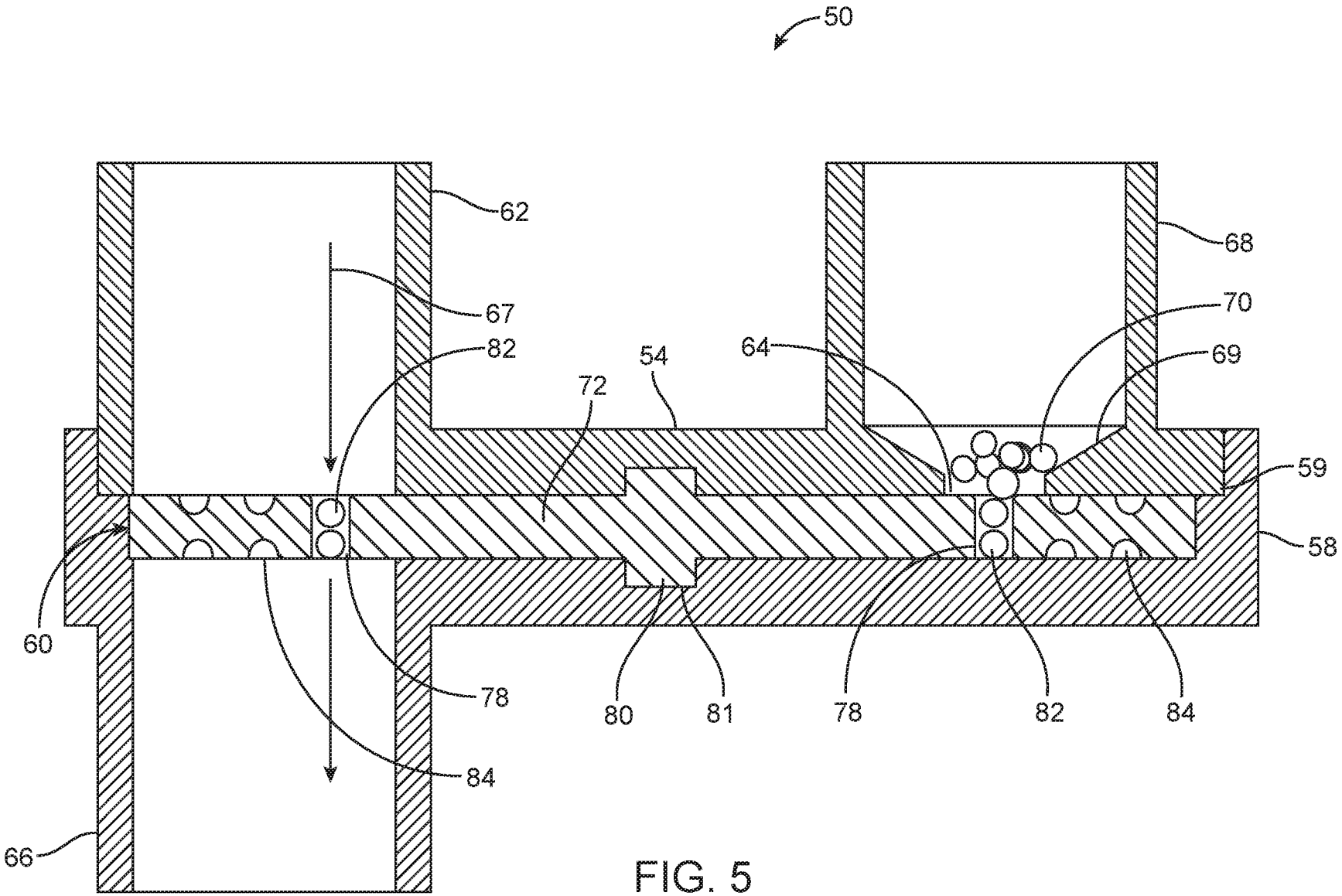
FIG. 5 is a prospective cross section view of an exemplary embodiment of the particulate dispenser in accordance with aspects of the present disclosure

FIG. 5 illustrates a cross section view of a particulate dispenser 50 in accordance with the disclosure herein. As noted previously, and as shown in FIG. 5, the housing 52 can have a receiving space 60 enclosed by the upper plate 54, the lower plate 56, and the at least one side wall 58. A wheel 72 can be received within the receiving space 60. The wheel 72 can have a top surface 74 and a bottom surface 76 and a distribution aperture 78 extending from the top surface 74 to the bottom surface 76. There can be at least one distribution aperture 78, alternatively, at least two distribution apertures 78, alternatively, a plurality of distribution apertures 78. The number of distribution apertures can include from 2-30 distribution apertures 78.

The fluid inlet aperture 62 and the fluid outlet aperture 66 can be substantially aligned along a longitudinal axis thereby permitting flow of fluid 67 through the receiving space 60 but for the presence of the wheel 72 interposed between the fluid inlet aperture 62 and the fluid outlet aperture 66. The fluid inlet aperture 62 and the fluid outlet aperture 66 in substantial alignment can mean the apertures are sufficiently aligned to permit the flow of particulate and/or fluid in the absence of obstacles. The fluid inlet aperture 62 and the fluid outlet aperture 66 are of sufficient size to permit the passage of particulate 70 and/or fluid 67 therethrough when in substantial alignment.

The hopper 68 can be communicatively coupled to the receiving space 60 by a particulate input aperture 64. As can be appreciated in FIG. 5, the hopper 68 can receive a plurality of particulate 70 to be distributed through the particulate input aperture 64. The particulate input aperture 64 can be formed in the upper plate 54 and at the base of the hopper 68 for feeding particulate 70 from the hopper 68. The particulate input aperture 64 can have a smaller diameter than the hopper 68. This permits the hopper 68 to hold or store a large proportion of particulate 70 until it is passed through the input aperture 64. The particulate input aperture 64 is sized equivalent to or slightly larger than a single particulate 70.

The wheel 72 is rotatable within the receiving space 60 of the housing 52. In one rotational configuration, a distribution aperture 78 is radially aligned with particulate input aperture 64 and can receive particulate 70. In a second rotational configuration, the distribution aperture 78 can be radially aligned with the fluid inlet aperture 62 and fluid outlet aperture 66. Accordingly, rotation of the wheel 72 can alternatively align a distribution aperture 78 with the hopper 68 and then align the same distribution aperture 78 with the fluid inlet aperture 62 and fluid outlet aperture 66. The alignment of the distribution aperture 78 with the particulate input aperture 64 causes the particulate 70 to be fed from the particulate input aperture 64 to the distribution aperture 78. Upon rotation and alignment of the distribution aperture 78 with the particulate input aperture 64, the particulate 70 is fed into the fluid 67 flowing through the distribution 78.

The wheel 72 can be mountable to the housing 52 via an axle 80. The axle 80 can be received in at least one axle groove 81 formed on the housing 52. The at least one axle groove 81 can be formed on the upper plate 54 and the lower plate 56. The axle 80 may also be integrally formed on a portion of either, or both, of the upper plate 54 or the lower plate 56.

As can be appreciated in FIG. 5, the wheel 72 can have distribution apertures 78 and a plurality of circumferentially spaced propulsion apertures 84. The plurality of propulsion apertures 84 can be angled from the top surface 74 of the wheel 72 to the bottom surface 76 of the wheel 72. As the fluid flows from the fluid inlet aperture 62 passing through the wheel 72 to the fluid outlet aperture 66, the flow of fluid 67 through the plurality of propulsion apertures 84 cause rotation of the wheel 72. The diameter of the fluid inlet aperture 62 and fluid outlet aperture 66 are sufficient to encompass and provide fluid flow path through both the distribution apertures 78 and propulsion apertures 84 when aligned. Accordingly, a portion of the fluid 67 passes through the propulsion apertures 84 on the wheel 72, and a portion of fluid 67 also passes through one of the distribution apertures 78. Accordingly, the flow of fluid 67 through the propulsion apertures 84 cause rotation of the wheel 72 and flow of fluid 67 causes introduction of particulate 70 into the flow of fluid 67 as the fluid 67 moves to the fluid outlet aperture 66.

On the other hand, the particulate inlet aperture 64 can be sized and/or shaped to cover only the distribution apertures 78, so as to avoid distribution of particulate 70 into the propulsion apertures 84.

The hopper 68 can be gravity fed and utilize the funneled end 69 to direct particulate into the at least one distribution aperture 78. The hopper 68 can be biased to urge particulate 70 into the at least one distribution aperture 78, such as by providing a spring bias or a weight.

The particulate 70 can include and/or be a plurality of tags 82. The tags can include radioactive isotopes that could be detected by radiation detectors such as scintillators. The tags 82 could include elements that have a high neutron cross section and become radioactive upon neutron activation, such as boron or cadmium, or upon activation by gamma rays. In this case, tags 82 could be activated by a pulsed neutron generator in a wireline tool, or by a radioactive source in a wireline tool. The particulate 70 and/or tags 82 can be ultra-small, e.g. 3 $mm^2$, such that they are pumpable in a sealant slurry. They may be approximately 0.01 $mm^2$ to 1 $mm^2$, alternatively 1 $mm^2$ to 3 $mm^2$, alternatively 3 $mm^2$ to 5 $mm^2$, or alternatively 5 $mm^2$ to 10 $mm^2$.

The tags 82 may be passive and may produce a return signal when energized or excited by an acoustic or electromagnetic interrogation signal. For example, the passive tags 82 may reflect the interrogation signal or return a harmonic of the interrogation signal. The tags 82 may be active and include transceivers that transmit acoustic or electromagnetic return signals in response to receiving an acoustic or electromagnetic interrogation signal. The transceivers could delay the return signals or the return signals could be tuned to frequencies different from the interrogation signal so that the return signals would be more clearly distinguished from reflections of the interrogation signal from the surrounding formation. Active tags may be addressable by the interrogation signal. For example, active acoustic tags or radio frequency identification (RFID) tags may be addressable by a digital code in the interrogation signal. The tags 82 may be Micro-Electro-Mechanical System (MEMS) data sensors. MEMS embody the integration of mechanical elements, sensors, actuators, and electronics on a common substrate. MEMS devices are minute in size, have low power requirements, are relatively inexpensive and are rugged, and thus are well suited for use in wellbore servicing operations. The MEMS data sensors may also include a resonant circuit designed to create a characteristic response in a sensing device for tag detection. MEMS data sensors can include the active RFID tags as described.

Figure 6:
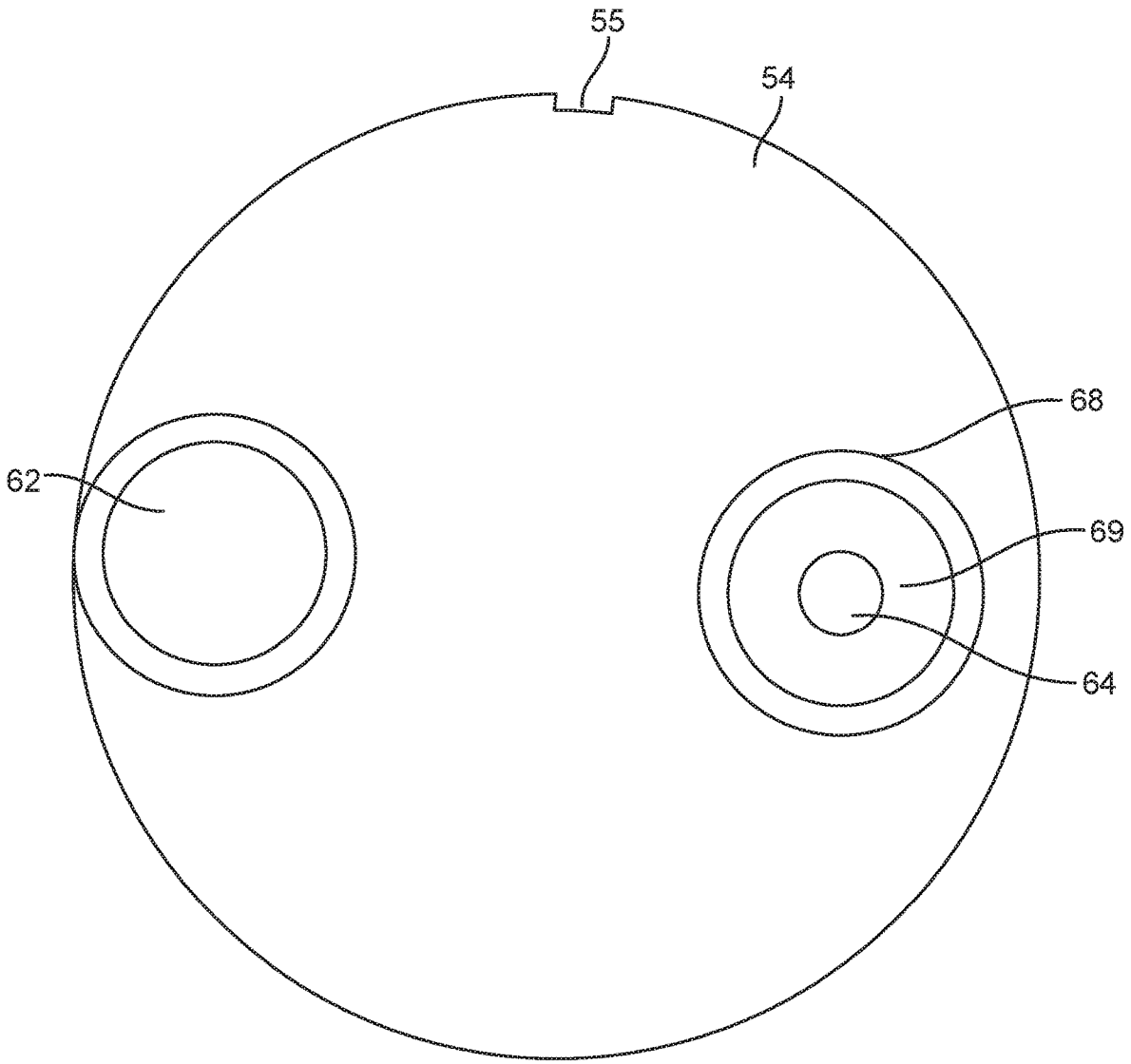
FIG. 6 is top plan view of an exemplary embodiment of a particulate dispenser in accordance with aspects of the present disclosure.

FIG. 6 illustrates a top plan view of an example embodiment of an upper plate 54 of a particulate dispenser 50. As shown, the upper plate 54 has a fluid inlet aperture 62 and a hopper 68. Additionally, the particulate inlet aperture 64 is disposed at the base of hopper 68. The hopper 68 can have a funneled end 69 which is sloped to distribute particulate 70 through the particulate inlet aperture 64 and into one of the distribution aperture 64. As mentioned the diameter of the particulate inlet aperture 64 can be smaller than that of the hopper 68 to manage the rate of particulate introduced into the flowing fluid 67 while still allowing the hopper 68 to receive a quantity of particulate 70. The hopper 68 can be positioned anywhere on the upper plate 54 as long as the particulate inlet aperture 64 is aligned with the at least one distribution aperture 78 of the wheel and at least one of the fluid inlet aperture 62 and fluid outlet aperture 66 (shown in FIG. 5).

As illustrated in FIG. 6, the fluid inlet aperture 62 and the hopper 68 are disposed on opposite ends of the upper plate 54. The upper plate 54 can also have a groove 55 formed on an edge. The groove 55 can receive a corresponding protrusion 57 on the sidewall 58 of the lower plate 56 to properly align the upper plate 54 with the lower plate 56. (Shown in FIG. 4.)

Figure 7:
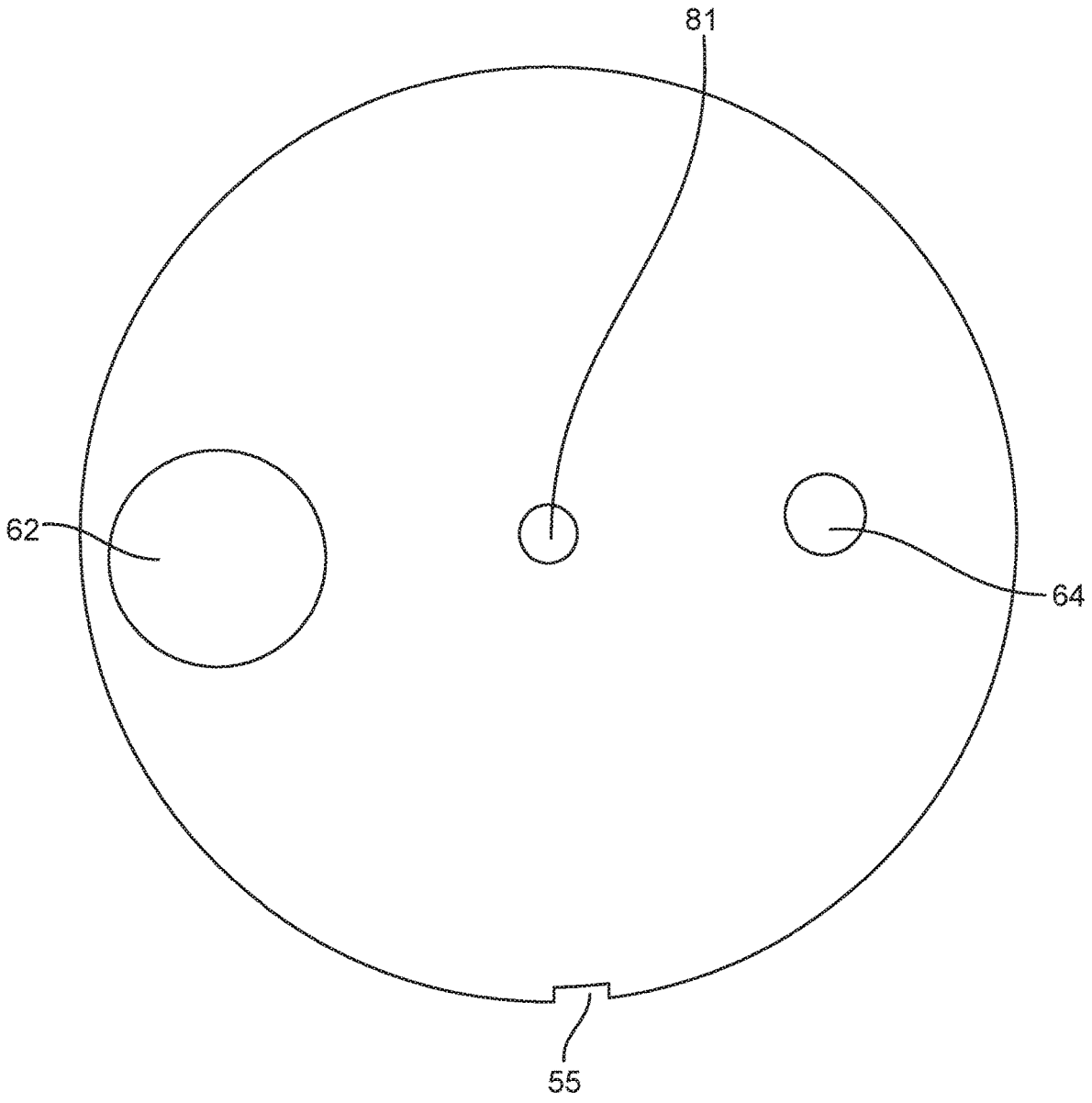
FIG. 7 is a bottom plan view of a lid of an exemplary embodiment of a particulate dispenser in accordance with aspects of the present disclosure.

FIG. 7 illustrates a bottom plan view of an example embodiment of an upper plate of a particulate dispenser. As shown, the upper plate 54 has an axle groove 81 formed in the bottom surface. The axle groove 81 can receive at least a portion of the axle 80 about which the wheel 72 rotates.

Figure 8:
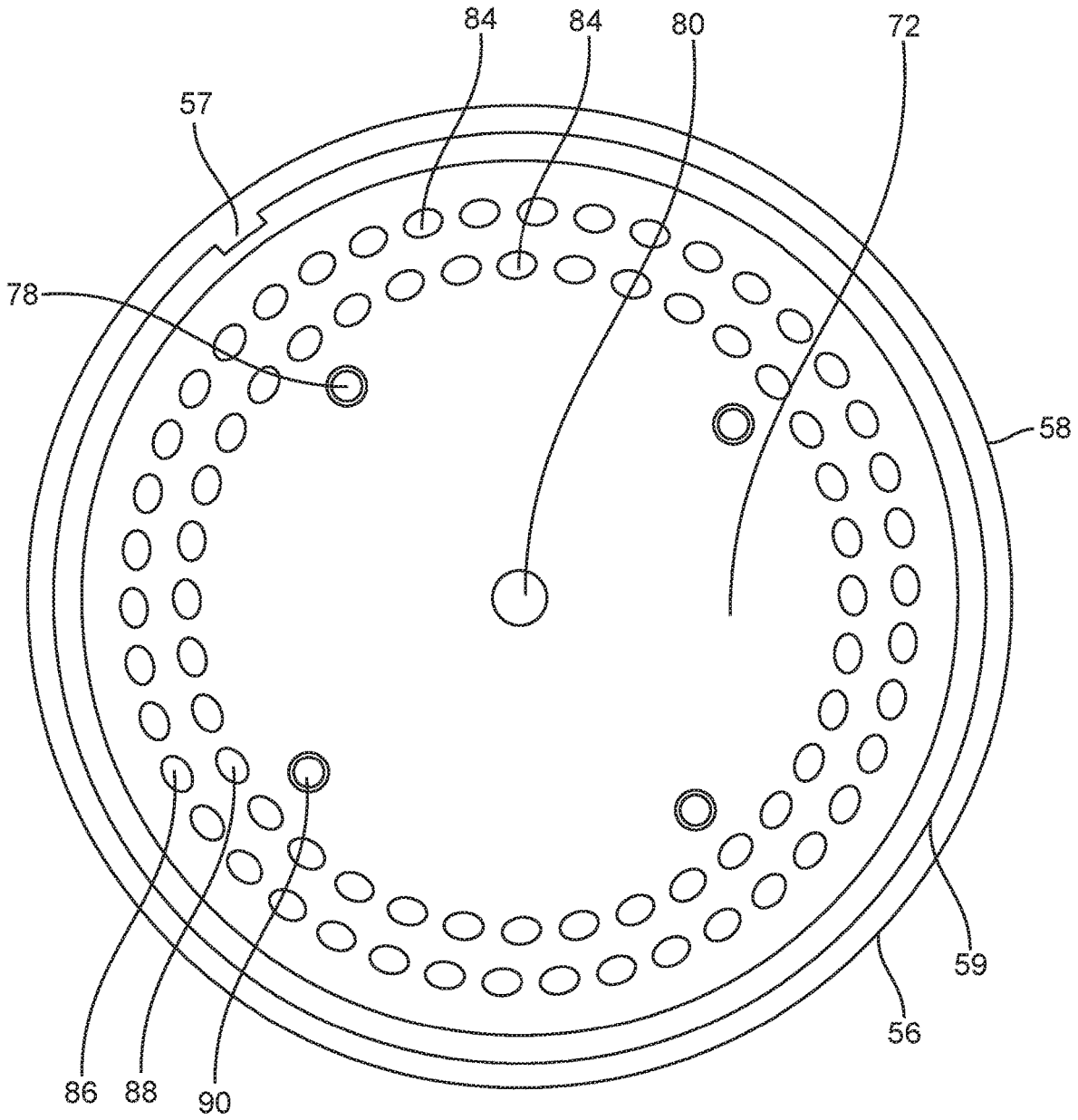
FIG. 8 is a top plan view of an exemplary embodiment of the particulate dispenser of FIG. 4 without a lid in accordance with aspects of the present disclosure.

FIG. 8 illustrates a top down plan view of an example embodiment of a particulate dispenser 50 having the upper plate 54 removed. The protrusion 57 can be matingly received in the groove 55 formed on the upper plate 54 to properly align the upper plate 54 and the lower plate 56 (shown in FIGS. 6 and 7). The lower plate 56 can have a ridge 59 formed on the inner surface of the side wall 58. The ridge 59 can act as a seat and support for the upper plate 54 when installed onto the housing 52 of the particulate dispenser 50.

The lower plate 56 of the particulate dispenser 50 can have a wheel 72 disposed in the receiving space 60. The wheel 72 can have a plurality of circumferentially spaced propulsion apertures 84. As shown, the plurality of propulsion apertures 84 can be formed in two circumferentially spaced rings, a first ring 86 and a second ring 88. The wheel 72 also has at least one distribution aperture 78, showing four distribution apertures 78 in the illustrated embodiment. The wheel 72 may include a third ring 90 of circumferentially spaced distribution apertures 78. The propulsion apertures 84 and distribution apertures 78 can be circumferentially spaced relative to the axle 80. The third ring 90 of distribution apertures 78 may have a smaller diameter than either of rings 86, 88 of propulsion apertures 84.

Figure 9:
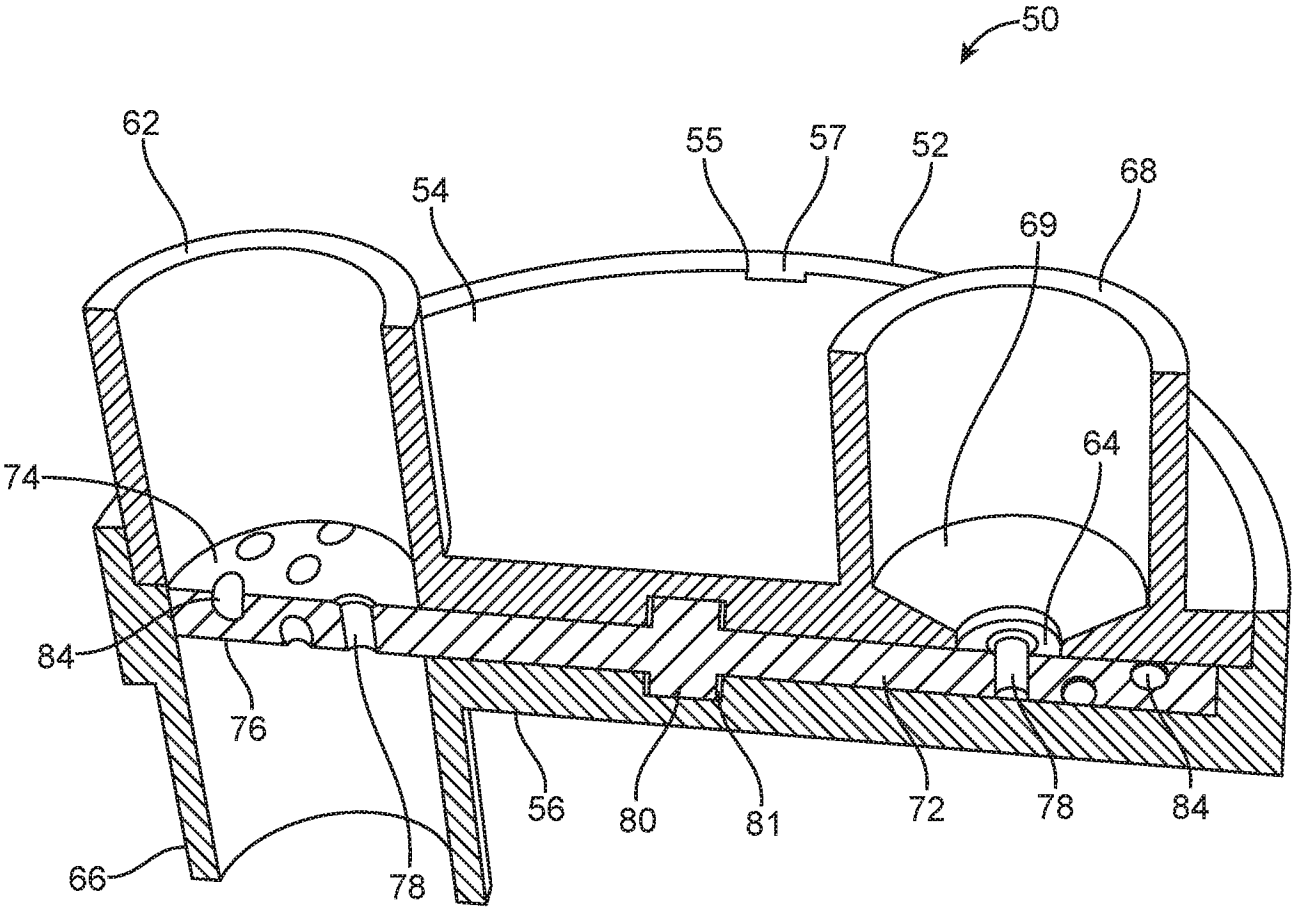
FIG. 9 is cross section view of an exemplary embodiment of the particulate dispenser in accordance with aspects of the present disclosure.

FIG. 9 illustrates a prospective cross section view of a particulate dispenser in accordance with certain embodiments. The housing 52 can have the lower plate 56 with protrusion 57 received in the groove 55 and the lower plate 56 seated on the ridge 59 of the lower plate 56 with the wheel 72 disposed in the receiving space 60. The fluid inlet aperture 62 can be substantially longitudinally aligned with the fluid outlet aperture 66 allowing a linear flow of fluid 67. As previously noted, for example with respect to FIG. 8, the wheel 72 can have two rings, the first ring 86 and the second ring 88, of circumferentially spaced propulsion apertures 84 and the third ring 90 of distribution apertures 78. The wheel 72 can rotate about axle 80 to allowing at least a portion of the wheel 72 to pass through the flowing fluid 67, thereby exposing a portion of the two rings 86, 88 of circumferentially spaced propulsion apertures 84 and at least one distribution aperture 78.

The hopper 68 can be disposed on the upper plate 54 and radially aligned with the plurality of distribution apertures 64 as the wheel 72 rotates within the housing 52. The hopper 68 can have a funneled end 69 to distribute particulate 70 through the particulate inlet aperture 64 and into one of the distribution apertures 64. As particulate 70 is placed into the distribution aperture 78, the funneled end 69 of the hopper 68 can be shaped to block the propulsion apertures 84, preventing accidental distribution of particulate 70 into the propulsion apertures 84. After receiving particulate, the distribution aperture 64 is rotated into alignment with at least one of the fluid inlet aperture 62 and fluid outlet aperture 66.

As can be appreciated in FIG. 9, the two rings 86, 88 of circumferentially spaced propulsion apertures 84 have a larger diameter than the third ring 90 of circumferentially spaced distribution apertures 78.

Figure 10:
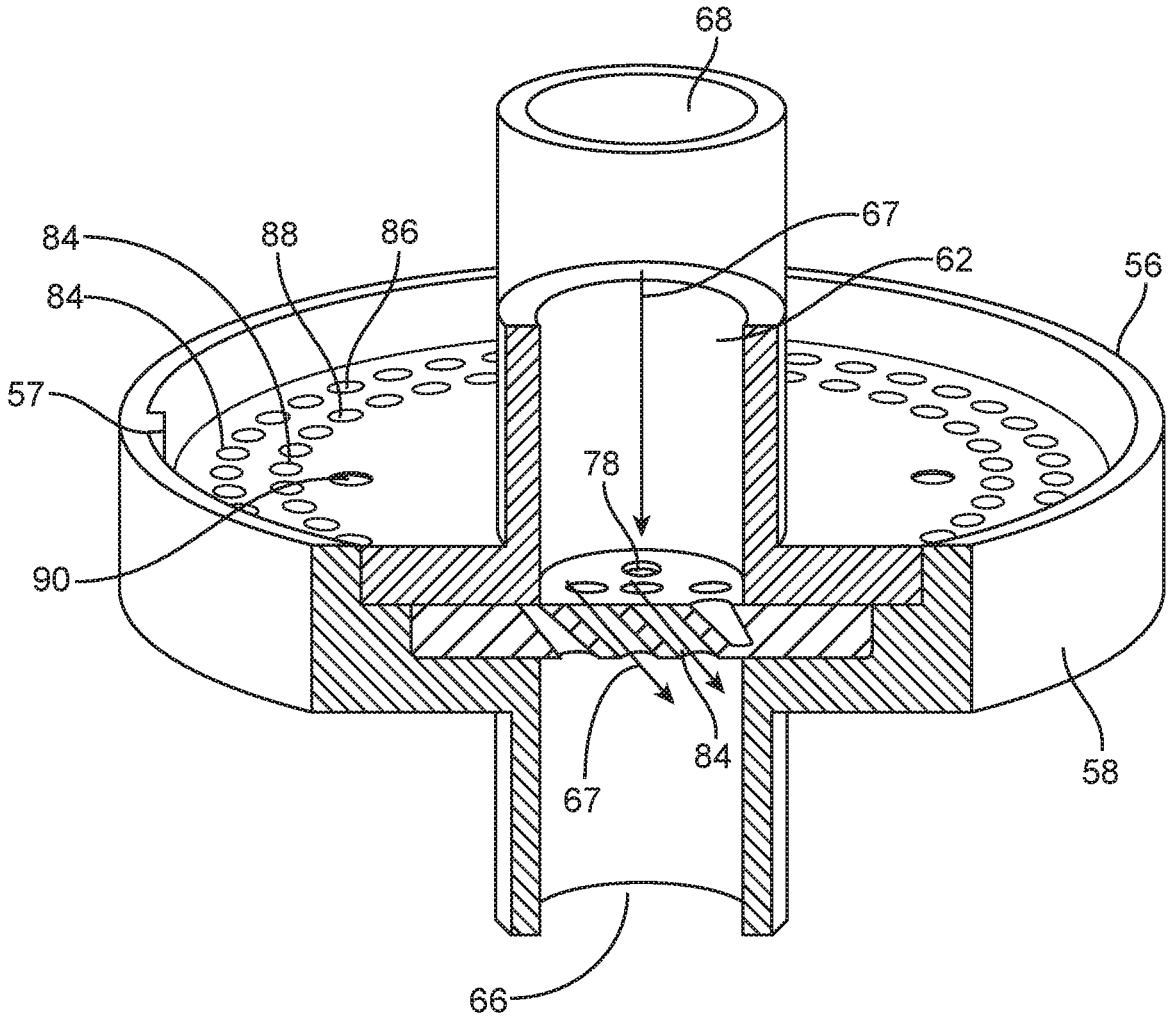
FIG. 10 is partial cross section view of an exemplary embodiment of the particulate dispenser in accordance with aspects of the present disclosure.

FIG. 10 illustrates a partial cross section of a particulate dispenser 50. As shown, the plurality of propulsion apertures 84 can be angled from the top surface 74 of the wheel 72 to the bottom surface 76 of the wheel 72. The angle can of the propulsion apertures 72 can be between 15 and 75 degrees with respect to the bottom surface 76 of the wheel 72. The fluid 67 passing through the propulsion apertures 84 urges rotation of the wheel 72 within the housing 52 of the particulate dispenser.

The angle of the propulsion apertures 72 adjusts the rotational speed of the wheel 72 based on the fluid flow rate, and thus the distribution of particulate 70. Depending on the number of distribution apertures 84, angle of propulsion apertures 84, and fluid flow rate, a specific rotational speed of the wheel 72 and target rate of distribution of particulate 70 can be achieved.

The wheel 72 of the particulate dispenser 50 can be interchangeable depending on the specific application and parameters of the application. The wheel 72 can include from 1-30 distribution apertures 78.

To obtain a high distribution of particulate 70 the wheel 72 can have a higher number of distribution apertures 78, such as 8-30, alternatively 12-25, or in particular 20 distribution apertures can be utilized. Alternatively, a low distribution of particulate 70 can be obtained, in which case a wheel 72 having a lower number of distribution apertures can be utilized. For instance, the wheel 72 can have 1-3 distribution apertures 78, can be utilized, or in particular 2. The number and angle of propulsion apertures 84 can be varied to adjust the distribution rate of the particulate 70. In the illustrated embodiments of FIGS. 4-12, four distribution apertures 78 are employed.

Figure 11:
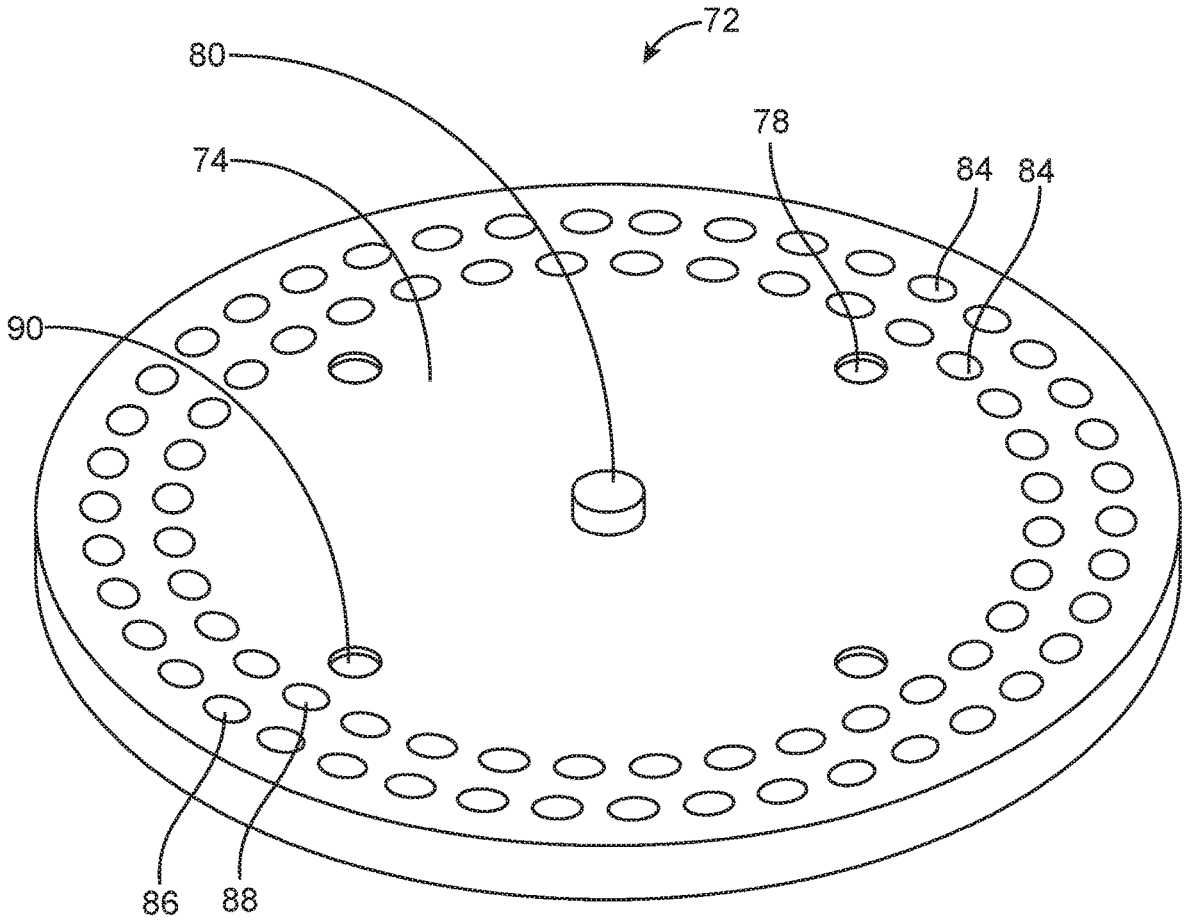
FIG. 11 is an isometric view of an exemplary embodiment of a wheel of a particulate dispenser in accordance with aspects of the present disclosure.

FIG. 11 illustrates a hydraulically operated wheel of a particulate dispenser 50 as disclosed herein. The wheel 72 can be hydraulically powered using a plurality of propulsion apertures 84. The propulsion apertures 84 can be circumferentially spaced on the wheel 72. As shown, the plurality of propulsion apertures 84 are arranged in a first ring 86 of circumferentially spaced propulsion apertures 84 and a second ring 88 of circumferentially spaced propulsion apertures 84 with the first ring 86 having a greater diameter than the second ring 88.

The wheel 72 can have a plurality of distribution apertures 78 arranged in a third ring 90. The diameter of the third ring 90 can be less than the diameter of the second ring 88. Alternatively, the diameter of the third ring 90 can be greater than the diameter of the second ring 88, but less than the diameter of the first ring 86. Additionally, the wheel 72 can have at least one vane formed on the side wall to urge rotation of the wheel 72 as fluid flows through the particulate dispenser 50.

The wheel 72 can have an axle 80 about which rotation is achieved. The axle can be integrally formed into the wheel, such as a protrusion extending above top surface 74 and below the bottom surface 76. The axle 80 can be press fit into an aperture formed at the center of the wheel 72.

Figure 12:
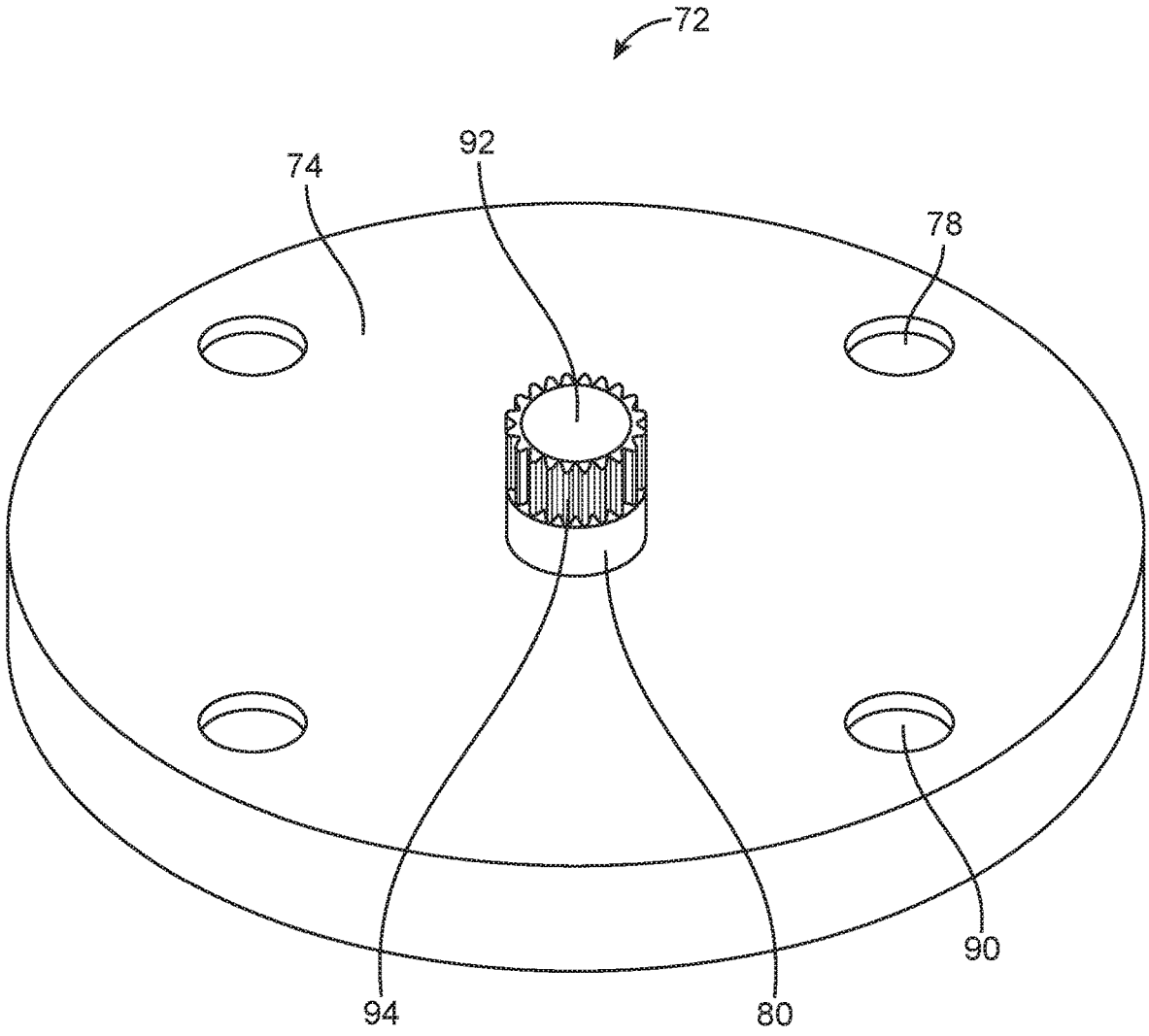
FIG. 12 is an isometric view of an exemplary second embodiment of a wheel of a particulate dispenser in accordance with aspects of the present disclosure.

FIG. 12 illustrates a mechanically operated wheel of a particulate dispenser 50 as disclosed herein. The wheel 72 can have a top surface 74 having only a plurality of distribution apertures 84 formed therein. The distribution apertures 84 can be formed in a third ring 90, similar to the hydraulically operated wheel shown in FIG. 11. As can be appreciated in FIG. 12, the wheel 72 can have an axle 80 about which rotation is achieved. The axle 80 can have at least one splined end 92 for mechanically coupling the axle 80 to a gear arrangement driven by a motor to rotate the wheel 72. The splined end 92 can have splines 94 shaped as gear teeth for meshing with another gear of the gear arrangement.

The axle can be integrally formed into the wheel, such as a protrusion extending above top surface 74 and below the bottom surface 76. In other embodiments, the axle 80 can be press fit into an aperture formed at the center of the wheel 72.

Figure 13:
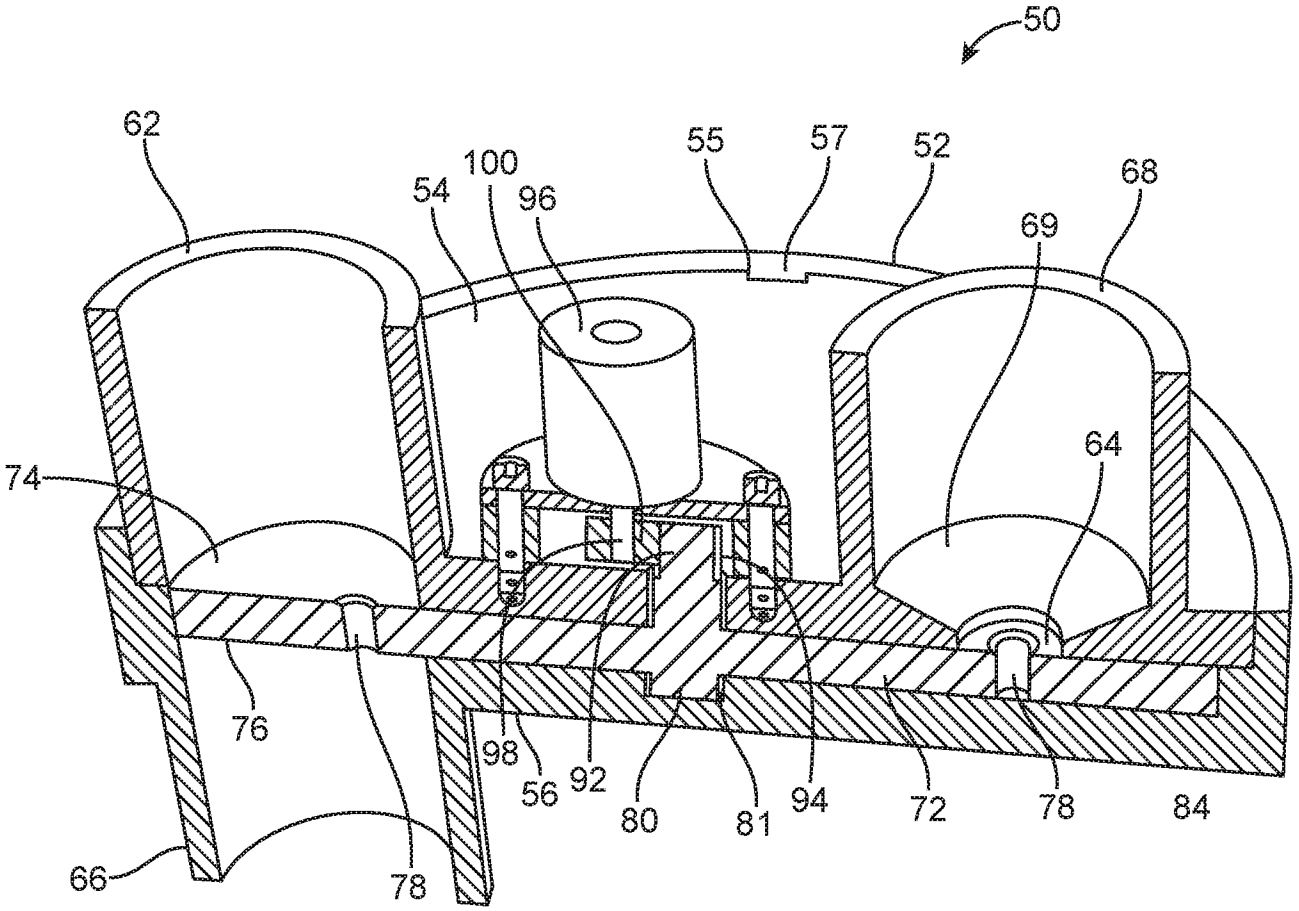
FIG. 13 illustrates a partial cross section view of an exemplary second embodiment of the particulate dispenser having a wheel of FIG. 12 in accordance with aspects of the present disclosure.

FIG. 13 illustrates a mechanically operated wheel 72 disposed within a particulate dispenser 50. The housing 52 can have a motor 96 disposed thereon. A shaft 98 having a corresponding gear 100 can be coupled to the motor 96. The corresponding gear 100 can engage with the splines 94 of the splined end 92. The motor 96 can be an A/C motor, a D/C motor, a servo motor, or an internal combustion engine. As the motor rotates the shaft 98, the corresponding gear 100 rotates causing rotation of the wheel 72 via the splined end 92.

As can be appreciated in FIG. 13, the motor 96 can be disposed in substantially the middle of the upper plate 54 of the housing 52. The motor 96 can have a shaft 98 and corresponding gear 100 that engages the splined end 92 above the upper plate 54. Alternatively, the upper plate 54 can have a groove formed there into allow the shaft 98 and corresponding gear 100 to engage the axle 80 of the wheel 72 within or below the upper plate 54. The motor 96 can be optionally be disposed on the lower plate 56, or can be a separate element removed from the particulate dispenser 50 and engaged with shaft 98 and corresponding gear 100.

Figure 14:
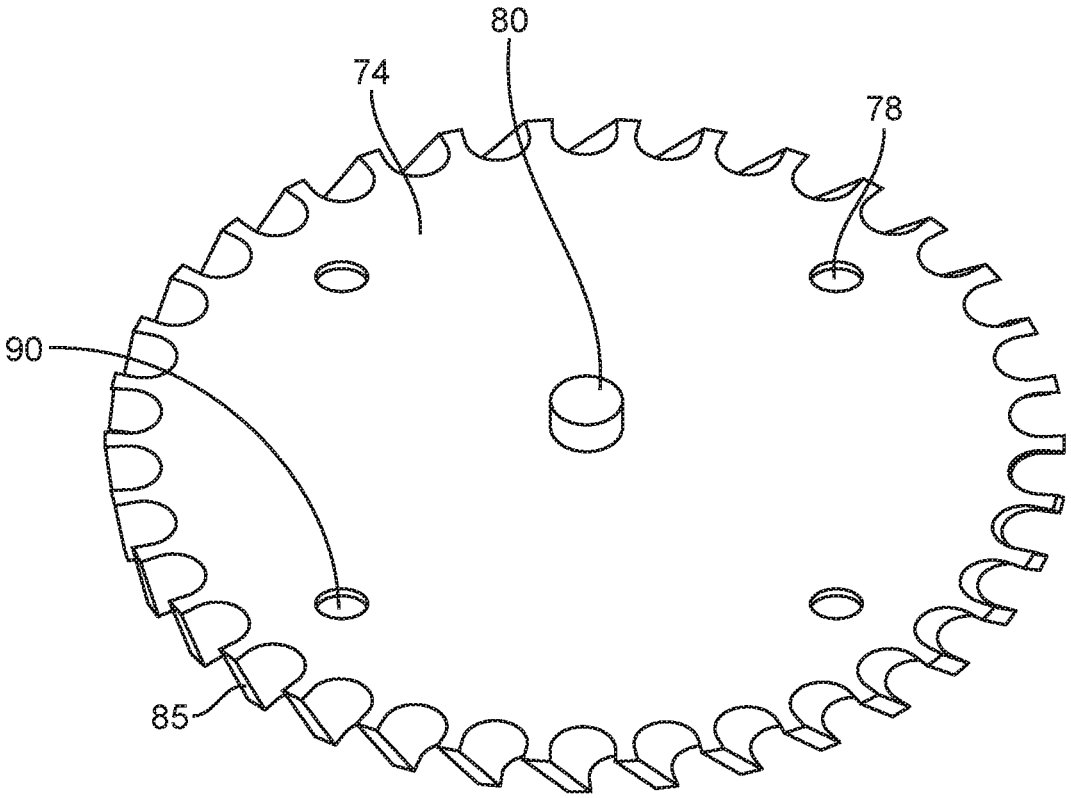
FIG. 14 illustrates an isometric view of an exemplary third embodiment of a wheel of a particulate dispenser in accordance with aspects of the present disclosure.

FIG. 14 illustrates a third embodiment of a wheel 72 capable of being disposed within a particulate dispenser 50. As can be appreciated in FIG. 14, a wheel 72 can have a plurality of vanes 85 arranged circumferentially around the perimeter of the wheel 72. The plurality of vanes 85 can be angled, such as 15-75 degrees, or in particular 45 degrees relative to the vertical axis. The plurality of vanes can urge the wheel 72 to rotate within the particulate dispenser 50 housing 52 as fluid flow 67 passes from the fluid inlet aperture 62 to the fluid inlet aperture 66.

Figure 15:
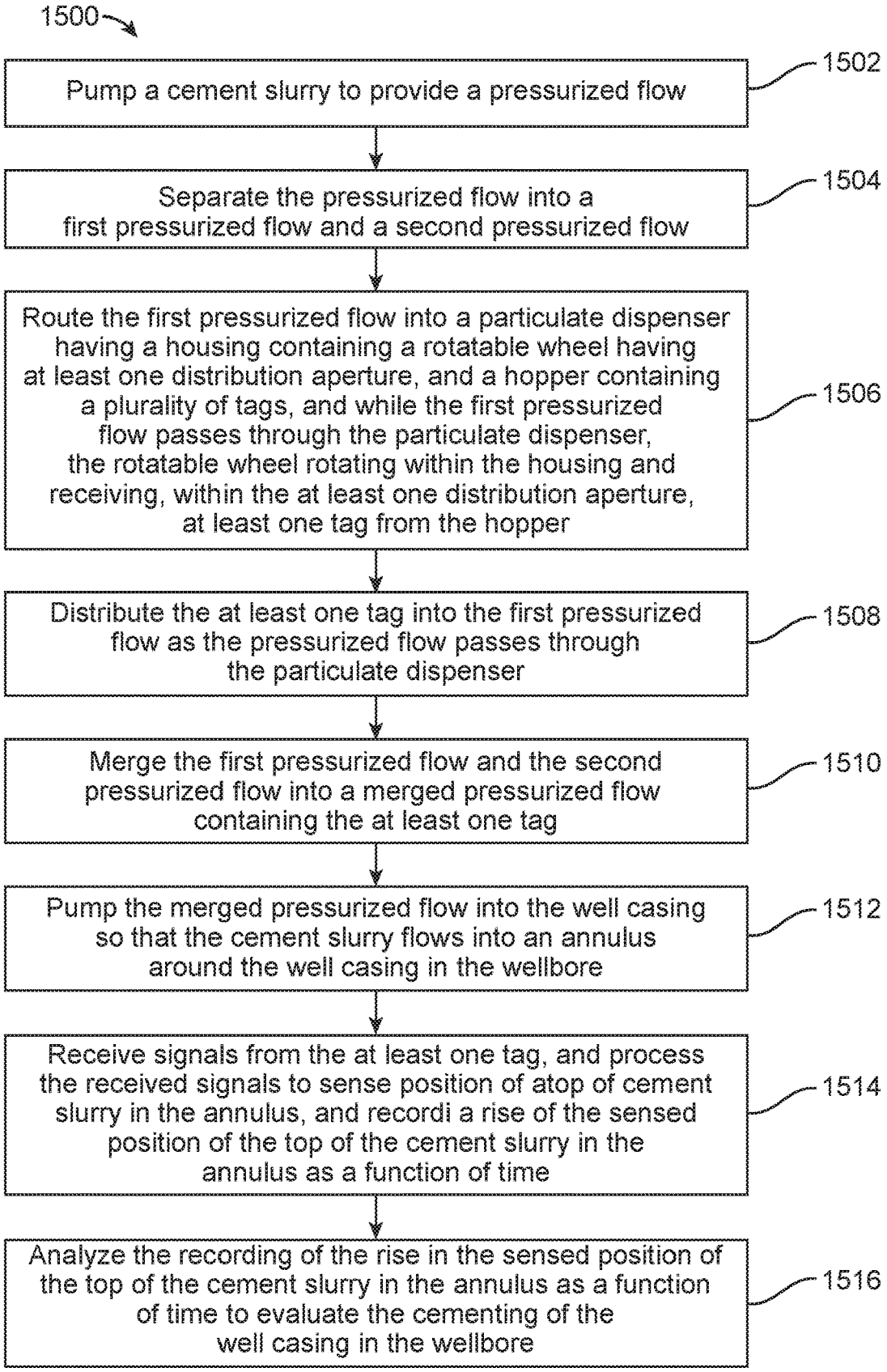
FIG. 15 is a flow chart of an exemplary method of a particulate dispenser in accordance with aspects of the present disclosure.

Referring to FIG. 15, a flowchart is presented in accordance with an example embodiment. The method 1500 is provided by way of example, as there are a variety of ways to carry out the method. The method 1500 described below can be carried out using the configurations illustrated in FIGS. 1-14, for example, and various elements of these figures are referenced in explaining example method 1500. Each block shown in FIG. 15 represents one or more processes, methods or subroutines, carried out in the example method 1500. Furthermore, the illustrated order of blocks is illustrative only and the order of the blocks can change according to the present disclosure. Additional blocks may be added or fewer blocks may be utilized, without departing from this disclosure. The example method 1500 can begin at block 1502.

At block 1502, a system 2 used in preparation of a cement composition and delivery to a wellbore can use pumping equipment 6 to pump a cement slurry toward the wellbore 22. The pumping equipment 6 can output a pressurized flow of the cement slurry. The method 1500 can then proceed to block 1504.

At block 1504, the pressurized flow of the cement slurry can be separated into a first pressurized flow and a second pressurized flow. The first pressurized flow and the second pressurized can be approximately equal, alternatively, the first pressurized flow can be volumetrically less than the second pressurized flow. The method 1500 can then proceed to block 1506.

At block 1506, the first pressurized flow can be routed into a particulate dispenser 50 having a housing 52 containing a rotatable wheel 72 having at least one distribution aperture 78, and a hopper 68 containing a plurality of tags 82, and while the first pressurized flow passes through the particulate dispenser 50, the rotatable wheel 72 rotating within the housing 52 and receiving, within the at least one distribution aperture 78, at least one tag 82 from the hopper 68. The wheel 72 can be hydraulically operated by the fluid flowing through the particulate dispenser 50. Alternatively, the wheel 72 can be mechanically operated by a splined axle coupled at one end to the wheel 72 and to a motor at the other end. The method 1500 can then proceed to block 1508.

At block 1508, as the wheel 72 rotates within the housing 52 and the first pressurized flow passes through the particulate dispenser 50, the at least one tag is distributed into the first pressurized. Rotation of the wheel 72 moves one of the at least one distribution apertures 78 from alignment with the hopper to alignment with the first pressurized flow. The first pressurized flow dislodges the tag 82 from the wheel 72 and distributes the tag into the flow. As the first pressurized flow rotates the wheel 72, a tag 82 is distributed in evenly in the flow of cement slurry. The distribution of tags 82 within the cement slurry can be adjusted by using different wheels having more or less distribution apertures. The quantity and arrangement of propulsion apertures 84 on the wheel 72 can be adjusted to increase or decrease distribution of tags 82 within the cement slurry. The method 1500 can then proceed to block 1510.

At block 1510, the first pressurized flow and the second pressurized flow can be merged into a merged pressurized flow containing cement slurry with the at least one tag disposed therein. The method 1500 can then proceed to block 1512.

At block 1512, the merged pressurized flow is pumped into the well casing 30 so that the cement slurry flows into an annulus 32 around the well casing 30 in the wellbore 22. The method 1500 can then proceed to block 1514.

At block 1514, the system 2 can receive signals from the at least one tag 82, and process the received signals to sense position of a top of cement slurry in the annulus, and record a rise of the sensed position of the top of the cement slurry in the annulus as a function of time. The method 1500 can then proceed to block 1516.

At block 1516, the system 2 can analyze the recording of the rise in the sensed position of the top of the cement slurry in the annulus as a function of time to evaluate the cementing of the well casing in the wellbore 22.

Statements of the Disclosure Include:

Statement 1: A particulate dispenser comprising a housing having an upper plate and a lower plate and at least one side wall enclosing a receiving space, the upper plate having a fluid inlet aperture and a particulate input aperture, and the lower plate having a fluid outlet aperture, a hopper disposed above the upper plate and coupled to the upper plate to feed particulate from the hopper to the particulate input aperture, a wheel residing in the receiving space of the housing, the wheel having a top surface and a bottom surface and at least one distribution aperture extending from the top surface to the bottom surface, and an axle mounting the wheel to the housing for rotation of the wheel in the housing, the apertures being disposed at respective positions so that rotation of the wheel alternately aligns the distribution aperture with the particulate input aperture to feed particulate from the particulate input aperture into the distribution aperture and then aligns the distribution aperture with the fluid input aperture and the fluid output aperture to feed the particulate from the distribution aperture into the fluid flowing through the distribution aperture as the wheel rotates.

Statement 2: The particulate dispenser of Statement 1, further comprising particulate contained in the hopper, and the particulate comprise a plurality of tags.

Statement 3: The particulate dispenser of Statement 2, wherein the plurality of tags comprises Radio Frequency Identification (RFID) tags.

Statement 4: The particulate dispenser according to any one of the Statements 1-3, wherein the wheel has at least one propulsion aperture, the at least one propulsion aperture being inclined from bottom surface of the wheel to the top surface of the wheel, wherein the at least one propulsion aperture causes the wheel to rotate as fluid flows through the inlet and outlet.

Statement 5: The particulate dispenser of Statement 4, wherein the at least one propulsion aperture has an angle of inclination between 15 and 75 degrees with respect to the bottom surface of the wheel.

Statement 6: The particulate dispenser of Statement 4, wherein the at least one propulsion aperture is a plurality of propulsion apertures circumferentially spaced on the wheel.

Statement 7: The particulate dispenser any one of the preceding Statements 1-6, wherein the plurality of propulsion apertures is arranged in a first ring of circumferentially spaced propulsion apertures and a second ring of circumferentially spaced propulsion apertures, and the diameter of the first ring is greater than the diameter of the second spaced ring.

Statement 8: The particulate dispenser of Statement 7, wherein the at least one distribution aperture is a plurality of distribution apertures arranged in a third ring of circumferentially spaced distribution apertures, the diameter of the third ring being less than the diameter of the second ring.

Statement 9: The particulate dispenser of Statement 7, wherein the at least one distribution aperture is a plurality of distribution apertures arranged in a third ring of circumferentially spaced distribution apertures, the diameter of the third ring being greater than diameter of the second ring and less than diameter of the first ring.

Statement 10: The particulate dispenser according to any one of the preceding Statements 1-9, wherein the wheel has at least one vane formed on a sidewall, wherein the at least one vane causes the wheel to rotate as fluid flows through the inlet and outlet.

Statement 11: The particulate dispenser to any one of the preceding Statements 1-10, wherein the axle of the wheel has a splined end for mechanically coupling the axle to a gear arrangement driven by a motor to rotate the wheel.

Statement 12: The particulate dispenser of Statement 11, wherein the splined end has splines shaped as gear teeth for meshing with another gear of the gear arrangement.

Statement 13: A method for particulate distribution in cementing a well casing in a wellbore in a subterranean formation, the method comprising pumping a cement slurry to provide a pressurized flow, separating the pressurized flow into a first pressurized flow and a second pressurized flow, routing the first pressurized flow into a particulate dispenser having a housing containing a rotatable wheel having at least one distribution aperture, and a hopper containing a plurality of tags, and while the first pressurized flow passes through the particulate dispenser, the rotatable wheel rotating within the housing and receiving, within the at least one distribution aperture, at least one tag from the hopper, distributing the at least one tag into the first pressurized flow as the pressurized flow passes through the particulate dispenser, merging the first pressurized flow and the second pressurized flow into a merged pressurized flow containing the at least one tag, and pumping the merged pressurized flow into the well casing so that the cement slurry flows into an annulus around the well casing in the wellbore.

Statement 14: The method of Statement 13, further comprising receiving signals from the at least one tag, and processing the received signals to sense position of a top of cement slurry in the annulus, and recording a rise of the sensed position of the top of the cement slurry in the annulus as a function of time.

Statement 15: The method of Statement 14, further comprising analyzing the recording of the rise in the sensed position of the top of the cement slurry in the annulus as a function of time to evaluate the cementing of the well casing in the wellbore.

Statement 16: A wellbore well casing cementing apparatus comprising a pump having an inlet and an outlet, the inlet drawing a cement slurry into the pump and the outlet expelling the cement slurry from the pump, the cement slurry having a higher pressure at the outlet, a particulate dispenser fluidically coupled to the outlet of the pump to receive the cement slurry, the particulate dispenser having a housing, a wheel, and a hopper, and the housing having an upper plate and a lower plate and at least one side wall forming a receiving space, and the wheel residing in the receiving space and having a top surface and a bottom surface and at least one distribution aperture extending from the top surface to the bottom top surface, and the wheel having an axle mounting the wheel to the housing for rotation of the wheel about the axle as the cement slurry passes through the particulate dispenser, the rotation of the wheel causing the at least one distribution aperture to move out of the cement slurry for receiving particulate from the hopper and to move into the cement slurry for depositing particulate from the at least one distribution aperture.

Statement 17: The apparatus of Statement 16, wherein the wheel has at least one propulsion aperture extending from the top surface of the wheel to the bottom surface of the wheel, the at least one propulsion aperture being inclined from the bottom surface of the wheel to the top surface of the wheel to propel rotation of the wheel as the cement slurry passes through the at least one propulsion aperture.

Statement 18: The apparatus according to Statement 16 or 17, wherein the hopper has an upper portion to receive particulate comprising a plurality of tags and a lower portion to distribute at least one of the plurality of tags into the at least one distribution aperture as the wheel rotates within the housing, the lower portion of the hopper being shaped to cover the at least one propulsion aperture and provide access to the at least one distribution aperture.

Statement 19: The apparatus according to Statement 17 or 18, wherein the at least one propulsion aperture is a plurality of propulsion apertures circumferentially spaced on the wheel.

Statement 20: The apparatus any of the preceding Statements 16-19, wherein the hopper contains particulate comprising a plurality of tags.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

What is claimed is:

1. A method for particulate distribution in cementing a well casing in a wellbore in a subterranean formation, the method comprising:

pumping a cement slurry to generate a pressurized flow;

separating the pressurized flow into a first pressurized flow and a second pressurized flow;

routing the first pressurized flow into a particulate dispenser having a housing containing a rotatable wheel having at least one distribution aperture, and a hopper containing a plurality of tags, and while the first pressurized flow passes through the particulate dispenser;

rotating the rotatable wheel within the housing and receiving, within the at least one distribution aperture, at least one tag from the hopper;

distributing the at least one tag into the first pressurized flow as the pressurized flow passes through the particulate dispenser;

merging the first pressurized flow and the second pressurized flow into a merged pressurized flow containing the at least one tag; and pumping the merged pressurized flow into the well casing so that the cement slurry flows into an annulus around the well casing in the wellbore, wherein the rotatable wheel has at least one propulsion aperture, the at least one propulsion aperture being inclined from bottom surface of the wheel to the top surface of the wheel and wherein the pressurized flow through the at least one propulsion aperture causes the rotatable wheel to rotate within the housing.

2. The method of claim 1, further comprising receiving signals from the at least one tag, and processing the received signals to sense position of a top of cement slurry in the annulus, and recording a rise of the sensed position of the top of the cement slurry in the annulus as a function of time.

3. The method of claim 2, further comprising analyzing the recording of the rise in the sensed position of the top of the cement slurry in the annulus as a function of time to evaluate the cementing of the well casing in the wellbore.

4. The method of claim 1, wherein the plurality of tags comprises at least one Radio Frequency Identification (RFID) tags.

5. The method of claim 1, wherein the at least one propulsion aperture is a plurality of propulsion apertures circumferentially spaced on the wheel.

6. The method of claim 1, wherein the at least one propulsion aperture has an angle of inclination between about 15 degrees and about 75 degrees with respect to the bottom surface of the wheel.

7. The method of claim 1, wherein the plurality of propulsion apertures is arranged in a first ring of circumferentially spaced propulsion apertures and a second ring of circumferentially spaced propulsion apertures, and the diameter of the first ring is greater than the diameter of the second spaced ring.

8. A wellbore well casing cementing system comprising:

a pump having an inlet and an outlet, the inlet drawing a cement slurry into the pump and the outlet expelling the cement slurry from the pump, the cement slurry having a higher pressure at the outlet;

a particulate dispenser fluidically coupled to the outlet of the pump to receive the cement slurry, the particulate dispenser having a housing, a wheel, and a hopper, and the housing having an upper plate and a lower plate and at least one side wall forming a receiving space, and the wheel residing in the receiving space and having a top surface and a bottom surface and at least one distribution aperture extending from the top surface to the bottom top surface, and the wheel having an axle mounting the wheel to the housing for rotation of the wheel about the axle as the cement slurry passes through the particulate dispenser, the rotation of the wheel causing the at least one distribution aperture to move out of the cement slurry for receiving particulate from the hopper and to move into the cement slurry for depositing particulate from the at least one distribution aperture, wherein the wheel has at least one propulsion aperture extending from the top surface of the wheel to the bottom surface of the wheel, the at least one propulsion aperture being inclined from the bottom surface of the wheel to the top surface of the wheel to propel rotation of the wheel as the cement slurry passes through the at least one propulsion aperture and wherein the at least one propulsion aperture is at least one vane formed on a sidewall, wherein the at least one vane causes the wheel to rotate as fluid flows through the inlet and outlet.

9. The system of claim 8, wherein the at least one propulsion aperture has an angle of inclination between about 15 degrees and about 75 degrees with respect to the bottom surface of the wheel.

10. The system of claim 8, wherein the hopper has an upper portion to receive particulate comprising a plurality of tags and a lower portion to distribute at least one of the plurality of tags into the at least one distribution aperture as the wheel rotates within the housing, the lower portion of the hopper being shaped to cover the at least one propulsion aperture and provide access to the at least one distribution aperture.

11. The system of claim 8, wherein the at least one propulsion aperture is a plurality of propulsion apertures circumferentially spaced on the wheel.

12. The system of claim 8, wherein the plurality of propulsion apertures are arranged in a first ring of circumferentially spaced propulsion apertures and a second ring of circumferentially spaced propulsion apertures, and the diameter of the first ring is greater than the diameter of the second spaced ring.

13. The system of claim 8, wherein the axle of the wheel has a splined end for mechanically coupling the axle to a gear arrangement driven by a motor to rotate the wheel.

14. The system of claim 8, wherein the hopper contains particulate comprising a plurality of tags.

15. The system of claim 14, wherein the plurality of tags comprises at least one Radio Frequency Identification (RFID) tags.

16. A method for particulate distribution in cementing a well casing in a wellbore in a subterranean formation, the method comprising:

pumping a cement slurry to generate a pressurized flow;

separating the pressurized flow into a first pressurized flow and a second pressurized flow;

routing the first pressurized flow into a particulate dispenser having a housing containing a rotatable wheel having at least one distribution aperture, and a hopper containing a plurality of tags, and while the first pressurized flow passes through the particulate dispenser;

rotating the rotatable wheel within the housing and receiving, within the at least one distribution aperture, at least one tag from the hopper;

distributing the at least one tag into the first pressurized flow as the pressurized flow passes through the particulate dispenser;

merging the first pressurized flow and the second pressurized flow into a merged pressurized flow containing the at least one tag; and pumping the merged pressurized flow into the well casing so that the cement slurry flows into an annulus around the well casing in the wellbore, wherein the rotatable wheel has at least one propulsion aperture, the at least one propulsion aperture being inclined from bottom surface of the wheel to the top surface of the wheel and wherein the at least one propulsion aperture is at least one vane formed on a sidewall, wherein the at least one vane causes the wheel to rotate as fluid flows through the inlet and outlet.

* * * * *